United States Patent [19]

Briand

[11] Patent Number: 4,526,566

[45] Date of Patent: Jul. 2, 1985

[54] CONICAL BOBBIN AND METHOD OF FORMING SAME

[76] Inventor: Jean P. Briand, 53 rue de la Papeterie, Fontaine-les-Luxeuil, France, 70800

[21] Appl. No.: 381,741

[22] Filed: May 24, 1982

[30] Foreign Application Priority Data

May 27, 1981 [FR] France ..... 81 10650

[51] Int. Cl.[3] ..... B31C 7/02

[52] U.S. Cl. ..... 493/296; 493/276; 493/287; 493/954

[58] Field of Search ..... 242/118, 118.3, 118.8, 242/130.1, 177; 229/1.5 R, 1.5 B, 4.5, DIG. 7; 493/269–289, 106, 107, 154, 155, 349, 954, 296; 156/503, 539–541

[56] References Cited

U.S. PATENT DOCUMENTS

| | | | |
|---|---|---|---|
| 371,989 | 10/1887 | Stone | 493/296 |
| 1,911,671 | 5/1933 | Blauvelt | 493/296 X |
| 2,056,636 | 10/1936 | Whiting, Jr. | 493/296 X |
| 2,080,619 | 5/1937 | Majer | 493/296 X |
| 2,644,376 | 7/1953 | Raymond | 493/296 |
| 3,402,646 | 9/1968 | Hall | 493/296 |

FOREIGN PATENT DOCUMENTS

| | | | |
|---|---|---|---|
| 773568 | 11/1934 | France | 493/296 |

*Primary Examiner*—James F. Coan

*Attorney, Agent, or Firm*—Mason, Fenwick & Lawrence

[57] ABSTRACT

A cone-shaped bobbin is formed by rolling and gluing a paper or the like blank on a mounting mandrel with the cone being formed with a decreasing number of layers of paper or the like from bottom to top. Three embodiments of the blank are disclosed respectively in the shape of a crescent, a half-crescent, and a comma.

18 Claims, 11 Drawing Figures

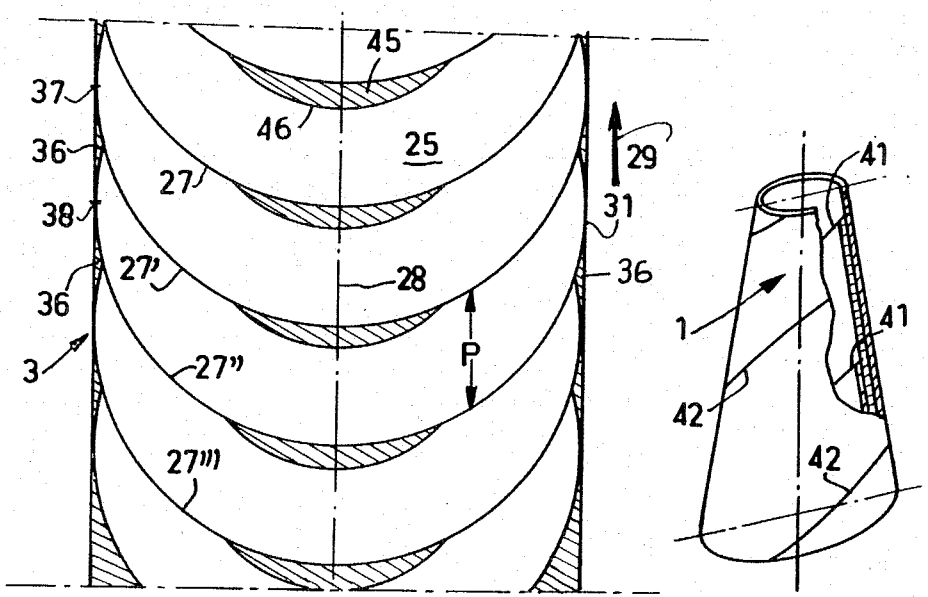
FIG. 9
FIG. 6
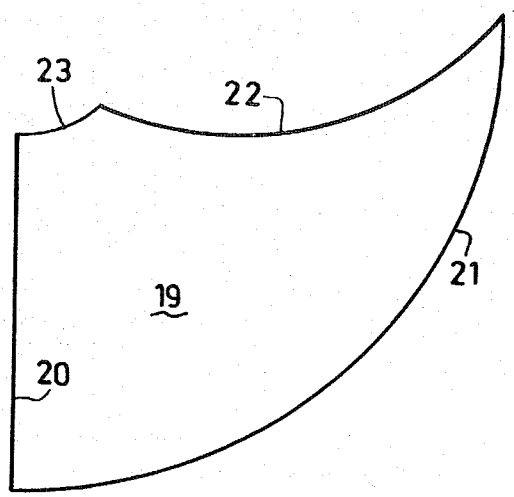
FIG. 5

CONICAL BOBBIN AND METHOD OF FORMING SAME

BACKGROUND OF THE INVENTION

The present invention concerns a process of making a bobbin in the form of truncated conical member particularly for use in winding textile threads and/or ribbons, of a type formed by rolling layers of a paper or cardboard blank on a conical mandrel and adhesively securing the layers together; the aforementioned blank is obtained by cutting a web of paper or cardboard and rolling the blank to make the trunk of the cone to be formed.

Obviously, the present invention also involves the truncated cone bobbins which are obtained by such a procedure.

In the textile industry, hollow truncated cone bobbins are widely used for winding threads or ribbons. These conventional support cones are characterized by being formed in a wide variety of different sizes, weights and dimensions of their sides so that their resistance to lateral compression at their bottom ends as well as resistance to crimping along their base and tops will vary. The exterior surface of conventional cones can be formed to give the choice between a smooth surface or a corrugated surface which can facilitate the clinging of the textile threads to the cones. Also, the exterior surface can be provided with slits, grooves, and/or perforations and at least one niche to enable securing of the end of the thread or ribbon to the cone.

In FIGS. 1 and 2, attached, of the first set of drawings for the present application, there is shown a perspective view and a cross-section of a truncated support cone 1, of conventional form, of which the height is designated by h, the radius at any point M of the trunk of the cone is designated by r, and the thickness of the hollow cone is shown by e. FIGS. 3 and 4 illustrate the traditional process of manufacture of such truncated support cones 1.

The conventional process consists of movable web 3 of paper or cardboard which is moved in the direction shown by arrow 2 supplied from a roll which is not depicted. The web is cut to provide polygonal templates or blank elements 4, generally symmetrical in relation to a longitudinal axis 3' of the web shaped somewhat in the form of chevrons placed side by side and one after the other. In this manner, two principal cuts are made along lines 5 and 6 repeatedly as shown so as to create a blank in the shape of a chevron having lower and upper edges 17 and 18 as shown in FIG. 4.

The two cuts 5 and 6 follow two incipient cuts 9 and 10 to result in the severing of the lateral points 7 and 8 of the chevron, when the principal cuts 5 and 6 are made. The web from which the chevron is cut has previously been provided with a roughened surface along each of its longitudinal edges. One of the roughened surfaces is provided on the lower face of the web and extends all along zone 11 following cut 10. The other roughened surface is provided on the upper face of the web and extends through zone 12 below cut 9. The roughened surfaces extend inwardly from each edge of the web approximately 25% of the width of the web. The chevron-shaped blank which is thus formed is then rolled around a mandrel along line 10 as shown by arrow 13. The roughened areas have adhesive applied to them in zones 11 and 12 so as to secure the ends of the blank to the body of the cone provided as the result of the rolling of the chevron-shaped blank.

In other words, for each template or blank 4 obtained in web 3 after four successive cuts, respectively 5-6-9-10, and after roughening the external surface 11 where the template begins, and internal surface 12 where it ends, one proceeds successively to various other operations to obtain the desired truncated cone, namely:

First, gluing of the exterior surface of the blank to itself while simultaneously rolling the blank around the mandrel and also simultaneously trimming the base and the tip, for example, with two blades.

The item is then dried and formation of the bottoms effected such as a crimping of the base and/or the tip of the trunk of the cone 1. The exterior surface can then be roughened to permit a better grip of the textile threads, and the slit is cut at the base of the trunk of the cone for receiving the end of the thread to be wound on the cone.

According to the actual process, one sees that there is created substantial waste of material consisting of areas 7 and 8 and the hatched surfaces 15, 15', and 16 as shown in FIG. 4. The loss of material is about 40% of the original material of the web 3.

On the other hand, according to the traditional method of manufacture indicated above, one creates truncated cone supports of which the thickness e is constant, due to the fact that there are the same number of layers of material at the base as at the tip.

A support cone supports thread or the like by lateral compression, and in order to obtain equal resistance along the whole height of cone, the thickness of the conical support should be proportional to the diameter at any particular location.

In effect, the stress at a point M on the surface of cone 1 (FIG. 2) on which the force due to the rolling of the thread upon the cone is equally shared is proportional to the relation ($p \times r/e$) in which p indicates the effective pressure.

Thus, the thickness e of the traditional cones being constant, greater stresses result at the base of the cone than at the upper end tip of the truncated cone 1 and, since at the same time, the lower end of the cone must have a thickness to resist maximum stress, which occurs at its base, a large quantity of waste material results in the upper end portions of the cone.

Finally, the machines currently used to manufacture such conventional truncated cone bobbins employ many mechanical movements, particularly the machine or machines which have the function of performing the four cuts in the web necessary for forming each blank, are slow in operation and consequently economically disadvantageous.

Therefore, it is the object of the present invention to provide a process of manufacture of bobbing in the form of truncated cone supports which permit a great reduction in the waste material and provide a maximum ratio of strength to weight while improving the speed and efficiency of production.

SUMMARY OF THE INVENTION

The basic idea of the present invention consists of obtaining a truncated cone bobbin of constant inertia, in which the ratio r/e is constant. This result is achieved by providing a thickness e which is greater at the base of the cone 1 than at the tip (top portion) of the cone as shown in dashed line in the right half of FIG. 2. The shape of the blank from which the cone is formed is such that waste is minimized. The lower end of the cone has a larger number of wrapped and glued layers to provide the increased thickness.

According to a preferred form of practice of the process of this invention, the repetitive operation of cutting the blanks transversely along the web width provides blanks having upper and lower borders in the form of parallel semi-circles. The semi-circles are centered either along the exterior longitudinal edge of the web or on the longitudinal axis of the web or between the longitudinal axis and the exterior border of the web and preferably near the web axis. The semi-circle cut is of a radius so that each curved cut is tangential to the longitudinal edge of the web.

According to a first variation of the invention, the web blanks are cut with a more or less crescent shape which is symmetrical in relation to the longitudinal axis of the web. Each crescent-shaped blank is located between two semi-circles whose centers are located on the longitudinal axis of the web and whose radii are identical and equal to the width of the web.

In a second variation, the web blanks are cut with a half-crescent shape with each blank being located between two semi-circles centered on the exterior longitudinal edge of the web and with a radius equal to the breadth of the web.

In another embodiment, the web blanks are cut in a comma shape with each blank being defined by two circular edges of equal radius having centers on a line spaced inwardly from and parallel to one edge of the web from which the blanks are cut.

During the rolling and overlapping in a helical arrangement of any of the previously described blanks, a slight excess of material is trimmed from the tip of said cone, and, if necessary, also from the base of the cone; for example, with the use of one or two cutting blades. The loss of material is reduced to a relatively minute percentage of the material used as compared to prior conventional procedures.

In summary, the present invention proposed three variations to form the blanks for forming the cone. Namely, a crescent shape, a half-crescent shape, or a comma shape. The truncated cone bobbins formed by such blanks present optimum strength along their height, permitting more efficiency in operation. The cuts are very simple to make and are also less in quantity (a single cut per blank instead of four as in the conventional manner). Also, there is a greatly reduced loss of material through waste.

Naturally, another aspect of the present invention also is the truncated cone bobbin formed by performing the inventive processes as describe above. The bobbin is characterized in that it consists of a strong lightweight cone which has an almost constant inertia all along its height.

A better understanding of the present invention will be achieved when the following detailed description of the several variations are considered in connection the attached drawings.

BRIEF DESCRIPTION OF THE DRAWINGS

FIG. 5 is a plan view of an ideal blank used for forming a cone-shaped bobbin with maximum efficiency;

FIG. 6 is a plan view illustrating the manner of cutting a web to form crescent-shaped blanks for forming cone-shaped bobbins by practice of a first embodiment of the invention;

FIG. 9 is a perspective view with a portion removed illustrating the process of rolling the crescent-shaped blank into a cone;

FIG. 5 illustrates the shape of an ideal blank 19 which would provide a cone having the ratio of r/e being a constant value. This blank, if wrapped around a vertical mandrel, would provide a cone in which the thickness increases with the diameter. This ideal blank member 19 is in a shape including a rectilinear edge 20 from which semi-circles 21 and 23 extend with a further semi-circle 22 extending between semi-circles 21 and 23. The arc of semi-circles 21 and 23 are concentric with respect to each other and consequently have the same center of curvature. The arc 23 constitutes the edge that will form the upper end tip of the cone-shaped bobbin, whereas the arc 21 constitutes the edge that will form the base of the cone-shaped bobbin.

However, some modification of the blank illustrated in FIG. 5 is necessary in order to cut the blanks from a continuous web for providing a minimum loss of waste material from the web. This modification is based upon a modification of one of the semi-circles, preferably the upper semi-circle 22 of the blank 19 so as to provide the blank 24 illustrated in FIG. 7. The blank 24 illustrated in FIG. 7 is of half-crescent shape and is symmetrical with respect to the rectilinear edge 20 of the web from which it is cut.

Figure 8:
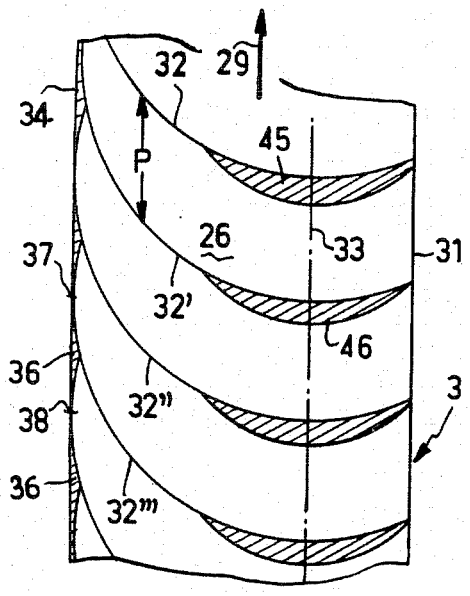
FIG. 8 is a plan view illustrating the manner of cutting a web to provide blanks in the shape of a comma as used in a third embodiment of the invention.

The blanks 26 illustrated in FIG. 8 are somewhat similar to the blanks 24 of 27; however, the blanks 26 curve upwardly to the right of line 33 to terminate along linear side edge 31. The shape of the blanks 26 to the left of line 33 is substantially the same as the shape of the half-crescent blanks 24 with the dimension "P" being reduced in ratio in comparison with the width of the blanks.

It should be noted that the symmetrical crescent-shaped templates 25 illustrated in FIG. 6 are provided by making successive cuts along semi-circles 27, 27', 27'', and 27''' with the aforementioned arcuate cuts being centered on the longitudinal axis 28 of the web from which the lengths are cut. In other words, the center of curvature of the cuts 27, 27', etc., lies along line 28 of FIG. 6. After the first cut 27 is made, the web is advanced in the direction of the arrow 29 and the second cut 27′ is effected. The web is then advanced further and the third cut, 27″, is effected with the process being repeated for providing as many blanks as are desired to be fabricated.

Figure 1:
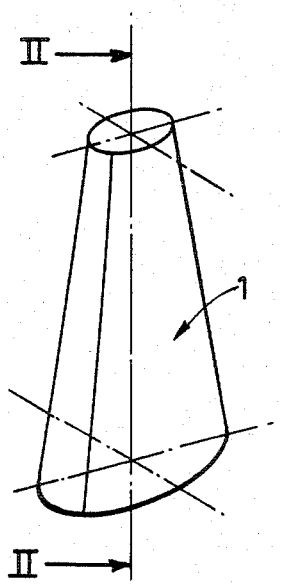
FIG.1 (PRIOR ART)
FIG. 1 is a perspective view of a conventional cone-shaped bobbin.
Figure 2:
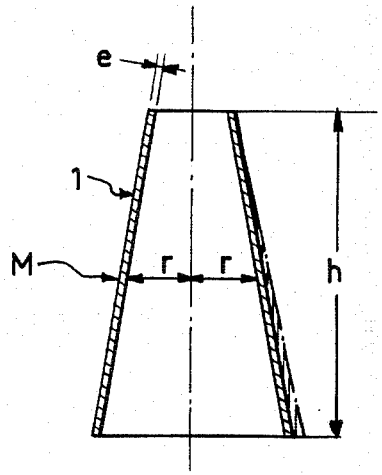
FIG. 2 (PRIOR ART)
FIG. 2 is a sectional view taken along lines II—II of FIG. 1 and also illustrating one aspect of the present invention.
Figure 3:
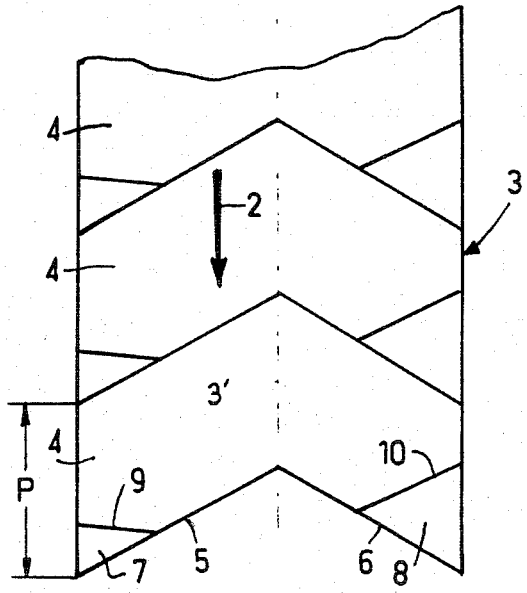
FIG.3 (PRIOR ART)
FIG. 3 is a plan view illustrating the conventional manner of cutting of a web for forming blanks to form the cone-shaped bobbin of FIGS. 1 and 2.
Figure 4:
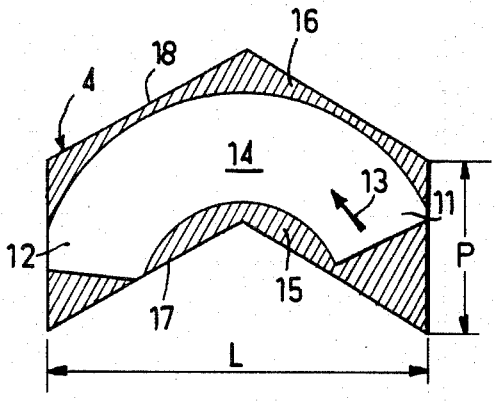
FIG.4 (PRIOR ART)
FIG. 4 is a plan view of an individual one of the conventional blank members illustrating waste material removed in the fabrication process.
Figure 7:
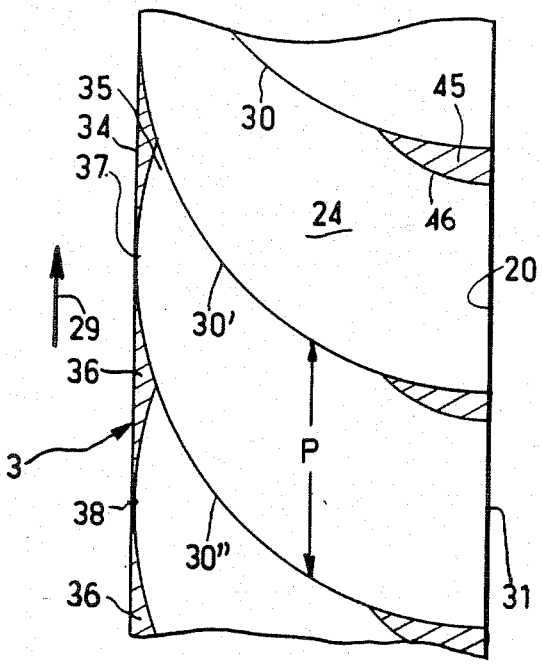
FIG. 7 is a plan view of a web illustrating the manner of cutting the web to form half-crescent shaped blanks for providing a second embodiment of the invention.

The half-crescent blanks 24 of FIG. 7 are fabricated by cutting semi-circles 30, 30′, 30″ in sequence across the width of the web to the linear edge 31. The radius of the arcs 30, 30′, etc., is equal to the width of the web 3 and the center of semi-circles 30, 30′, 30″, etc., are all on the right edge 20 of web 3.

The comma-shaped blanks 26 of FIG. 8 are provided by cutting the width of the web 3 along semi-circles 32, 32′, 32″, 32‴, etc., which are centered on line 33 positioned inwardly of and parallel to the right edge 31 of the web from which the blanks are cut. The radius of semi-circles 32, 32′, etc., is equal to the distance separating the line 33 from the other edge 34 of the web. Like the preceding examples, the blanks 26 are formed by first making the arcuate cut, then advancing the web, and then making the next arcuate cut.

Each of the blanks 24, 25, or 26 is respectively rolled onto a forming mandrel (not shown) having an outer conical surface shaped and dimensioned to provide a like inner surface for the particular cone being formed. The resultant cone always has a larger number of layers of the blank material at and adjacent its lower base end than it does near its upper tip portion. Adhesive is applied to the outer surface of the blank at or prior to the time it is rolled about the forming mandrel so that the layers of the blank adhere to each other to provide the finished construction.

More specifically, the rolling operation of the blank upon the forming mandrel begins by positioning the point tip 35 of either of the blanks 24, 25, or 26 adjacent the base of the forming mandrel following which the blank is wound about the mandrel. It should be noted at this juncture that the pointed end 35 of each of the respective blanks 24, 25, and 26 is defined upon one side by semi-circular edges 27, 30, or 32 respectively, each of which is tangential to the left edge 34 of the web from which the blank is cut. It should be noted that a small amount of material 36 of each blank positioned to the left of pointed ends 35 constitutes waste material resultant from the successive arcuate cutting steps. It should be further noted that the waste material 36 is positioned between tangent points 37 and 38 of succeeding arcuate cuts extending across the width of the web. Edge 31 of each of the respective blank members 24, 25, 26 can be of reduced thickness to avoid the extra thickness that would necessarily result from that portion of the edge being of the same thickness as the remainder of the blank.

Figure 10:
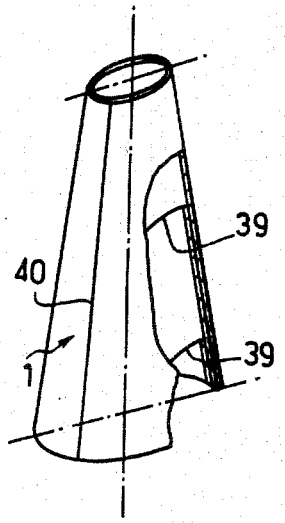
FIG. 10 is a perspective view with a portion removed illustrating the rolling of the half-crescent shaped blank into a cone.

When blank 24 is rolled onto the forming mandrel, the shape of the blank results in a helical interior edge 39 as shown in FIG. 10 with the exterior termination of the blank member being along linear line 40 which would intersect the apex of the cone and thus defines a generating line for the truncated cone-shaped bobbin 1 provided by the process when using the half-cresent shaped blank 24.

When a bobbin is formed using the crescent-shaped blank 25, the resultant cone has an identical helical interior roll edge 41 as shown in FIG. 9 and also has an exterior helical roll edge 42 as also shown in same figure. It should be observed that the helical roll edges provided both interiorly and exteriorly of the resultant cone bobbin formed from blanks 25 is the result of the symmetrical form of the blank 25 which is in effect a symmetrical union of two of the half-crescent shaped blanks 24.

Figure 11:
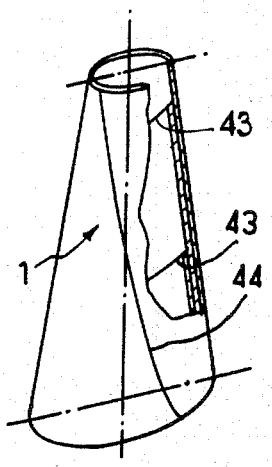
FIG. 11 is a perspective view with a portion removed illustrating the rolling of the comma-shaped blank into a cone.

The formation of a bobbin in the form of a truncated cone by the use of comma-shaped blanks 26 results in a bobbin having juncture roll edges comprising helical roll edges 43 on the interior which are identical to edges 39 and 41 of the other variations illustrated in FIGS. 9 and 10. However, the exterior edge of the cone formed from blanks 26 comprises a curved line 44 as shown in FIG. 11.

The various bobbins formed from the different blanks 24, 25, and 26 have minor variations in terms of advantages and disadvantages. For example, the bobbin formed from the half-crescent blank 24 provides an interior helical edge juncture which cannot be easily abraded to reduce its thickness, which is not necessarily a hindrance, whereas the right linear edge 31 of these blanks permits easy abrading to reduce thickness along that edge. Consequently, this type of bobbin has a somewhat reduced strength adjacent the lower base portion as compared to the other variations.

The bobbin cone obtained from the crescent-shaped blanks 25 has six layers at its base with two layers of material adjacent its upper end. Thus, the base is extremely strong, and bobbins formed of this shape can be formed with a lower grade paper while maintaining adequate strength. The disadvantage of this construction is that the helical line of juncture 42 is much more difficult to abrade for reducing its thickness than is a linear line.

The bobbin cones formed from the comma-shaped blanks 26 represent a compromise between the two other cones which, as a consequence, reduce the advantages and disadvantages as compared thereto. For example, the distance separating the exterior edge 31 from the center line 33 provides an interesting parameter in choosing between the quality of paper required for the cone and the surface quality of the cone following abrasion.

A substantial advantage of the present invention resides in the fact that the number of cuts necessary for forming each blank is only one-fourth the number of cuts required when using the conventinal four rectilinear cuts as previously practiced in the art. Moreover, the top and bottom surfaces of the cones are provided in an accurate manner with a minimum of waste resulting from the employment of the present inventive method. The waste material from the use of the crescent-shaped blanks 25 comprises central shaded areas 45 and side shaded areas 36. Similarly, the waste material from using the half-crescent blanks 24 comprises the areas 45′ and 36′ which are cross-hatched. Use of the comma-shaped blanks 26 results in wastage areas 45″ and 36″ as shown in FIG. 8. The wastage generally runs between 2% and 5% of the total area of the web 3.

Numerous modifications of the disclosed embodiments will undoubtedly occur to those of skill in the art, and it should therefore be understood that the spirit and scope of the invention is to be limited solely by the appended claims.

What is claimed is:

1. A process for the manufacture of a cone-shaped bobbin for use in the winding of textile threads or the like comprising the steps of cutting of a web of paper or cardboard into blanks having a predetermined shape which when wound on a forming mandrel provides a helical arrangement in which the large end of the cone thus formed contains a larger number of layers of the blank than does the small end of the said cone and then winding the blank onto a forming mandrel to form a cone having a greater number of layers of the blank in its large end than its small end while simultaneously adhesively securing the layers to each other.

2. A process as recited in claim 1, wherein said method includes the step of repetitively cutting blanks for forming said cone-shaped bobbin by cutting upper and lower edges thereof along parallel semi-circular cut lines.

3. A process according to claim 2, wherein the semi-circular cut lines are centered along a longitudinal edge of a web from which the blank members are cut and the blank is in the shape of a half-crescent and is wound on the forming mandrel so that the cone formed thereby has an interior helical roll edge and an exterior linear roll edge.

4. A process according to claim 2, wherein the semi-circular cut lines are centered along a longitudinal axis spaced inwardly of the edges of the web from which the blanks are cut.

5. A process according to claim 4, wherein the radius of each semi-circular cut line is such that each semi-circular cut line is tangential to one edge of the web from which said blanks are cut.

6. The method of claim 1, wherein each blank is cut in the shape of a crescent and is wound on the forming mandrel so that the cone formed thereby has both an interior and an exterior helical roll edge.

7. A process as recited in claim 2, wherein said blanks are wound in said mandrel so as to provide an outer edge termination of each blank oriented parallel to a generating line of said mandrel.

8. A process as recited in claim 2, wherein said blanks are in the general shape of a crescent and are symmetrical to a longitudinal axis of the web, each blank being defined in part by two semi-circles having diameters equal to the width of the web and having centers of curvature positioned on said longitudinal axis of the web.

9. The process of claim 2, wherein said blanks are symmetrical and are of approximate crescent shape and are in part defined by semi-circular edges having centers of curvature along a longitudinal axis of said web and are wound on said mandrel to provide a bobbin having interior and exterior roll edges of helical configuration.

10. A method of making a frustoconical support element from a single strip of planar material comprising the steps of cutting the strip from a web of the planar material and winding it with overlapping turns into a conically converging shape, the steps being carried out in such a way that more turns of the strip are superposed at the larger end of the element than at its smaller end so as to give the element more layers thickness of the said material at its larger end than at its smaller end.

11. A method of making a plurality of frustoconical elements according to the method of claim 10, the respective plurality of said strips being cut from the web in a step-and-repeat manner, each step-and-repeat cycle including the steps of cutting the web along an arc of a circle, the cut so made forming an edge of one strip and an opposed edge of the next successive strip, and advancing the web.

12. A method according to claim 11 in which the said arc of a circle is centered on a point between the edges of the web or the extensions thereof.

13. A method according to claim 12 in which the said arc of a circle is centered on a point substantially halfway between the edges of the web or the extensions thereof.

14. A method according to claim 13 in which, for each element, the straight line lying within the strip and along the radii of the arcs on either side of it and parallel with the longitudinal direction of the web is disposed along a generatrix of the frustocone in the complete element.

15. A method according to claim 12 in which the arc of a circle is tangential to an edge of the web.

16. A method according to claim 11 in which the shape of each strip before it is wound conically is defined solely by two successive said cuts along an arc of a circle either along or in conjunction with an edge of the web, the two successive cuts meeting to form a point; the strip being wound so that the radially outer cut is substantially aligned with the base edge of the frusto-conical element; and the wound strip being trimmed subsequently at the base, if necessary, and at the tip, substantially all of the material lost during the trimming being lost from the tip.

17. A method according to claim 16 in which the winding starts from the said point, successive turns being applied outside it, so that the radially inner of the two cuts forms a helical edge up the inside of the frusto-conical element.

18. A method according to claim 17 in which the wastage from the web is less than 5% or its area.

* * * * *